US009903394B2

(12) United States Patent
Brahmer

(10) Patent No.: US 9,903,394 B2
(45) Date of Patent: Feb. 27, 2018

(54) HYDRAULIC DRIVE WITH RAPID STROKE AND LOAD STROKE

(71) Applicant: Voith Patent GmbH, Heidenheim (DE)

(72) Inventor: Bert Brahmer, Bruchsal (DE)

(73) Assignee: Voith Patent GmbH, Heidenheim (DE)

( * ) Notice: Subject to any disclaimer, the term of this patent is extended or adjusted under 35 U.S.C. 154(b) by 105 days.

(21) Appl. No.: 14/856,980

(22) Filed: Sep. 17, 2015

(65) Prior Publication Data

US 2016/0084279 A1 Mar. 24, 2016

(30) Foreign Application Priority Data

Sep. 19, 2014 (DE) ..... 10 2014 218 884

(51) Int. Cl.
*F15B 11/08* (2006.01)
*F15B 13/04* (2006.01)
(Continued)

(52) U.S. Cl.
CPC ..... *F15B 13/0401* (2013.01); *B30B 15/161* (2013.01); *F15B 11/022* (2013.01);
(Continued)

(58) Field of Classification Search
CPC ..... B30B 15/161; B30B 15/20; F15B 11/022; F15B 2211/75; F15B 2211/76; F15B 2211/785; F15B 2211/20561; F15B 2211/27; F15B 2211/50563; F15B 2211/5157; F15B 2211/5158; F15B 2211/7053; F15B 2211/20538;
(Continued)

(56) References Cited

U.S. PATENT DOCUMENTS 7,234,298 B2 * 6/2007 Brinkman ..... E02F 9/2217 60/414
2003/0145588 A1 * 8/2003 Kubinski ..... F15B 7/08 60/475
2015/0292526 A1 * 10/2015 Saitoh ..... E02F 9/2289 60/477

FOREIGN PATENT DOCUMENTS

DE 32 19 730 A1 12/1983
DE 19600650 * 7/1997 ..... F15B 11/08
(Continued)

OTHER PUBLICATIONS

DE19600650 Machine Translation.*
(Continued)

*Primary Examiner* — Thomas E Lazo
*Assistant Examiner* — Dustin T Nguyen
(74) *Attorney, Agent, or Firm* — Taylor IP, P.C.

(57) ABSTRACT

A hydraulic drive including at least one hydraulic cylinder that includes a piston chamber, an annulus and a piston that separates the piston chamber from the annulus. The hydraulic drive further includes a first hydraulic pump that has a pump intake and a pump outlet, a directional control valve that has a first and a second switching position, and a second hydraulic pump. The second hydraulic pump has a direction of delivery that is consistent with the direction of delivery of the first hydraulic pump at the pump outlet, wherein the second hydraulic pump in the first switching position of the directional control valve is hydraulically connected with the piston chamber and the second hydraulic pump in the second switching position of the directional control valve is not hydraulically connected with the piston chamber.

15 Claims, 2 Drawing Sheets

(51) Int. Cl.

| | |
|---|---|
| ***F15B 13/02*** | (2006.01) |
| ***F15B 13/042*** | (2006.01) |
| ***B30B 15/16*** | (2006.01) |
| ***F15B 11/02*** | (2006.01) |
| *F15B 1/26* | (2006.01) |

(52) U.S. Cl.

CPC ..... *F15B 11/08* (2013.01); *F15B 13/024* (2013.01); *F15B 13/027* (2013.01); *F15B 13/042* (2013.01); *F15B 1/265* (2013.01); *F15B 2211/20515* (2013.01); *F15B 2211/20538* (2013.01); *F15B 2211/20561* (2013.01); *F15B 2211/20576* (2013.01); *F15B 2211/255* (2013.01); *F15B 2211/27* (2013.01); *F15B 2211/30525* (2013.01); *F15B 2211/329* (2013.01); *F15B 2211/351* (2013.01); *F15B 2211/50563* (2013.01); *F15B 2211/5157* (2013.01); *F15B 2211/5158* (2013.01); *F15B 2211/7051* (2013.01); *F15B 2211/7053* (2013.01); *F15B 2211/75* (2013.01); *F15B 2211/76* (2013.01); *F15B 2211/785* (2013.01)

(58) Field of Classification Search

CPC .. F15B 2211/20515; F15B 2211/20576; F15B 2211/255; F15B 2211/30525; F15B 2211/329; F15B 2211/625; F15B 2211/7051; F15B 2211/351; F15B 13/0401; F15B 1/027; F15B 1/04; F15B 11/08; F15B 13/024; F15B 13/027; F15B 13/042; F15B 1/265; F15B 2211/505; F15B 2211/5152; F15B 2211/78563; F15B 2211/20592; B03B 15/161; B15B 11/022

USPC ..... 60/475, 476

See application file for complete search history.

(56) References Cited

FOREIGN PATENT DOCUMENTS

| | | | | | |
|---|---|---|---|---|---|
| DE | 102010040755 | A1 | | 3/2012 | |
| DE | 10 2011 078 241 | B3 | | 9/2012 | |
| DE | 2011078241 | | * | 9/2012 | ..... F15B 11/024 |
| EP | 1 288 507 | A2 | | 12/1996 | |
| EP | 2 328 747 | B1 | | 4/2015 | |
| RU | 2296890 | | * | 11/2006 | ..... F15B 9/03 |
| WO | 2011/145947 | A1 | | 11/2011 | |

OTHER PUBLICATIONS

RU2296890 Machine Translation.*

DE102011078241 Machine Translation.*

German Office Action dated Oct. 28, 2015 for German Application No. 10 2014 218 884.9 (10 pages).

German Office Action dated May 27, 2015 for German Application No. 10 2014 218 884.9 (9 pages).

* cited by examiner

HYDRAULIC DRIVE WITH RAPID STROKE AND LOAD STROKE

BACKGROUND OF THE INVENTION

1. Field of the Invention

The invention relates to a hydraulic drive, in particular for a hydraulic press. The invention moreover relates to a method to operate a hydraulic drive.

2. Description of the Related Art

Hydraulic drives are widely known from the current state of the art. In practice, it is desirable for hydraulic drives, in particular for hydraulic drives for hydraulic presses to provide a hydraulic drive that, on the one hand provides a rapid movement of a drive piston in a so-called rapid stroke or rapid movement with low force and with which on the other hand a slower action with great force is possible in a so-called load stroke or load movement.

Various drives are known for this purpose from the current state of the art. In one drive with a so-called throttle control, the control and changeover between rapid stroke and load stroke through control of the volume flow occurs hereby via flow resistances between the pressure supply and cylinder. A disadvantage of such a drive with throttle control is the low efficiency due to the occurring flow losses.

Drives having a so-called displacement control system are moreover known from the current state of the art. A drive of this type may for example comprise a variable speed motor that drives two pumps having opposite delivering directions. The two pumps are connected via a hydraulic cylinder in such a way that the pump takes in hydraulic oil from one piston chamber of a hydraulic cylinder, whereas it moves hydraulic oil into the other piston chamber. The changeover from rapid stroke to load stroke, or respectively the speed control of the hydraulic drive occurs thereby through changing of the displacement volume of the pump or respectively through a change in the rotational speed of the motor. A variable displacement pump with changeable displacement volumes is expensive and noisy. Further, when using a pump having a constant displacement volume a changeover from a rapid stroke to a load stroke is not at all possible. A disadvantage of such a drive with a displacement control system without rapid and load stroke is that the motor must have a higher speed for the high speed in the rapid stroke, whereas a high maximum torque is required for the high force in the load stroke mode. Therefore, because of this high so-called peak performance the hydraulic drive becomes large, heavy, slow and expensive.

What is needed in the art is a hydraulic drive that can be operated with lower efficiency losses in a rapid stroke and a load stroke mode and whereby the motor should be able to be produced cost effectively.

SUMMARY OF THE INVENTION

The present invention provides a hydraulic drive that includes at least one hydraulic cylinder having a piston chamber, a first hydraulic pump and a second hydraulic pump, and a directional control valve such that the second hydraulic pump is hydraulically connected to the piston chamber in a first switching position and is not hydraulically connected from the piston chamber in a second switching position.

The hydraulic drive according to the present invention includes a directional control valve that has a first and a second switching position, and at least a second hydraulic pump, whose direction of delivery is consistent with the direction of delivery of the first hydraulic pump at the pump outlet. The second hydraulic pump in the first switching position of the directional control valve is hydraulically connected with the piston chamber. The second hydraulic pump in the second switching position of the directional control valve is not hydraulically connected with the piston chamber. The hydraulic pumps may all be driven by a single variable speed electric motor, whereby in one direction of rotation of the electric motor the first hydraulic pump at the pump outlet and the second hydraulic pump have an identical direction of delivery and whereby the first hydraulic pump at the pump intake has a delivery direction thereto in the opposite direction.

Consequently, hydraulic fluid can be moved (pumped) into the piston chamber in one rotational direction of the electric motor with the first hydraulic pump at the pump outlet, and the second hydraulic pump, whereby hydraulic fluid can be moved (sucked) out of the annulus at the pump inlet with the first hydraulic pump. Upon a reversal of the rotational direction of the electric motor the delivery direction of the hydraulic pumps can therefore also be reversed, so that then with the first hydraulic pump at the pump outlet, and the second hydraulic pump hydraulic fluid can be moved (sucked) out of the piston chamber, whereby with the first hydraulic pump hydraulic fluid can be moved (pumped) into the annulus at the pump intake. Pump intake and pump outlet are understood to be merely pump connections of the first hydraulic pump. The first hydraulic pump may be driven by a variable speed electric motor whose direction of rotation is reversible.

The electric motor can be designed as an asynchronous motor, a reluctance motor or also as a synchronous motor. The motor can also be operated without sensors (open loop) if a suitable frequency converter is provided. It is however also conceivable to equip the electric motor with a rotary encoder. This would then be referred to as a closed-loop operation. A control mode can be achieved with a synchronous motor in a closed-loop operation.

It is possible to also provide more than two hydraulic pumps. It is hereby for example conceivable to include ten hydraulic pumps, whereby the first hydraulic pump at the pump outlet, as well as the second to the tenth hydraulic pump have an identical delivery direction and whereby only the first hydraulic pump at the pump inlet has an opposite direction of delivery thereto.

If, in the first switching position of the directional control valve, the first hydraulic pump is connected at the pump outlet, and the second hydraulic pump with the piston chamber, hydraulic fluid can be moved (pumped) during operation of the hydraulic drive with the first and the second hydraulic pump into the piston chamber of the hydraulic cylinder, whereas hydraulic fluid can be moved (sucked) with the first hydraulic pump at the pump intake out of the annulus of the hydraulic cylinder. Consequently, the joint delivery volume of the first hydraulic pump at the pump outlet and of the second hydraulic pump can act upon the piston chamber. The hydraulic drive or respectively the piston of the hydraulic cylinder can be moved in a so-called rapid stroke at high speed.

If, in the second switching position of the directional control valve, only the pump outlet of the first pump is connected with the piston chamber, hydraulic fluid can be moved (pumped) with the first hydraulic pump at the pump outlet into the piston chamber of the hydraulic cylinder, whereas with the first hydraulic pump hydraulic fluid can be moved (sucked) out of the annulus of the hydraulic cylinder at the pump intake. Now only the delivery volume of the first pump can act on the piston chamber. Since now only the first pump is associated with the fluid exchange with the hydraulic cylinder, a higher pressure in the piston chamber of the hydraulic cylinder can be generated with the unchanged motor torque of the electric motor. The hydraulic drive or respectively the piston of the hydraulic cylinder can now be moved in a so-called load stroke at a greater force and slower speed.

A further development of the hydraulic drive provides that the first hydraulic pump can be designed as a four-quadrant pump or as two separately designed pumps delivering in opposite directions. It is hereby possible if the two pumps delivering in opposite directions can provide identical delivery volumes.

Another development of the hydraulic drive provides that the piston chamber has a hydraulic effective surface and that the annulus has a hydraulic effective surface, whereby the joint delivery volume of the first hydraulic pump at the pump outlet and the second hydraulic pump relative to the delivery volume of the first hydraulic pump at the pump intake can be at a ratio that is consistent with the surface ratio of the hydraulic effective surface of the piston chamber relative to the hydraulic effective surface of the annulus.

Due to the fact that the joint delivery volume of the first hydraulic pump at the pump outlet and of the second hydraulic pump are adapted to the hydraulic effective surface of the piston chamber and that the delivery volume of the first hydraulic pump at the pump intake is adapted to the hydraulic effective surface of the annulus, it can be achieved that the entire, or respectively almost the entire hydraulic fluid that is necessary to move the piston in the rapid stroke can be moved (pumped) by the pumps into the piston chamber or can be moved (sucked) out of the annulus. Occurrence of vacuums and over pressures can thus be largely avoided.

Furthermore, subsequent sucking of hydraulic fluid out of a tank by check valves that are provided for this purpose can largely be foregone. If more than two hydraulic pumps are provided the delivery volume of the first hydraulic pump at the pump intake may be adapted to the hydraulic effective surface of the annulus, whereas the joint delivery volume of the first hydraulic pump at the pump outlet and of all other hydraulic pumps may be adapted to the hydraulic effective surfaces of the piston chamber. In the load stroke, the ratio of the delivery volumes of the hydraulic pumps may then no longer be adapted to the surface ratio of the hydraulic effective surfaces, since now only the first hydraulic pump participates in the fluid exchange with the hydraulic cylinder. Therefore, additional necessary hydraulic fluids may be, for example, subsequently sucked by a check valve out of a tank.

An additional arrangement of the hydraulic drive provides that a tank can be provided that is hydraulically connected with the hydraulic pumps. In this tank hydraulic fluid can be stored either without pressure or with pressure. For the event that during operation of the hydraulic drive vacuums occur, hydraulic fluid can be sucked from the tank. For the event that during operation of the hydraulic drive excess pressures occur, hydraulic fluid can be diverted into the tank.

The tank may be in the embodiment of a pressure tank. It can hereby be provided that the pressure tank may be designed as a bladder accumulator, diaphragm accumulator or piston accumulator.

The directional control valve may be hydraulically controllable in such a way that the pressure in the piston chamber is used for shifting the directional control valve from the first into the second switching position. For this purpose, a control line can be used that connects the piston chamber with the directional control valve. Therefore, the pressure from the piston chamber can be used for shifting the directional control valve from the first into the second switching position. If the pressure in the piston chamber rises above a pressure limit that is preset, for example, by a return spring, the valve can be moved against the force of the return spring from the first switching position into the second switching position. If the direction of rotation of the electric motor is reversed for a return stroke of the hydraulic drive and consequently also the delivery directions of the pumps are reversed, then the first pump moves hydraulic fluid at the pump outlet and the second hydraulic pump out of the piston chamber of the hydraulic cylinder, whereas the first hydraulic pump moves hydraulic fluid at the pump intake out of the annulus of the hydraulic cylinder. The piston of the hydraulic cylinder can be moved back into its starting position in a rapid stroke.

The directional control valve may also be hydraulically controllable in such a way that the pressure in the annulus is used for shifting the directional control valve from the second into the first switching position. For this purpose, a control line may be provided that connects the annulus with the directional control valve. The pressure from the piston chamber can thus be used for switching the directional control valve from the second into the first switching position. If the pressure in the piston chamber, for example, does not drop below the pressure limit that is preset by the return spring, for example, when the counter force in the load stroke and thus also the high pressure in the piston chamber are present to a point of reversal of the pressing motion of a hydraulic press, a return shift from the second into the first switching position can be enabled by the pressure in the annulus. If the direction of rotation of the electric motor has already been reversed for a return stroke of the hydraulic drive and consequently also the direction of delivery of the pumps was reversed, but however the directional control valve was not yet switched backed into the first switching position, the pressure in the annulus of the hydraulic cylinder increases, since the first pump at the pump intake moves (pumps) more hydraulic fluid into the annulus than the first pump at the pump outlet moves (sucks) out of the piston chamber. If the pressure in the annulus now rises above a preset pressure limit, the directional control valve can be again switched into the first switching position through hydraulic forcible guidance. The piston of the hydraulic cylinder can again be moved into its starting position in a rapid stroke.

The hydraulic pumps can be designed as fixed displacement pumps, for example as gear pumps.

A position sensor and/or at least one pressure sensor can be provided. Pressure sensors may be provided in the piston chamber and in the annulus of the hydraulic cylinder for measuring the pressure. A position and speed control of the piston of the hydraulic cylinder can be realized with a position sensor. A position speed-and-force control can be realized with a hydraulic drive that includes a position sensor, as well as a pressure sensor.

An additional arrangement of the hydraulic drive provides that check valves and pressure relief valves can be provided which are arranged between the pump outlet of the first hydraulic pump and the second hydraulic pump and the piston chamber or respectively between the pump intake of the first hydraulic pump and the annulus in such a way that hydraulic fluid can be diverted into the tank in order to avoid excess pressures and that hydraulic fluid can be moved (sucked) out of the tank in order to avoid vacuums.

The present invention also provides a method to operate a hydraulic drive. Hydraulic fluid is moved in a rapid stroke by the first hydraulic pump at the pump outlet and by the second hydraulic pump into the piston chamber, whereby the first hydraulic pump at the pump intake moves hydraulic fluid out of the annulus, whereby in a load stroke only the first hydraulic pump moves hydraulic fluid at the pump outlet into the piston chamber and the first hydraulic pump moves hydraulic fluid at the pump intake out of the annulus, whereby the changeover from rapid stroke to load stroke occurs through switching the directional control valve from the first into the second switching position.

If, in the rapid stroke, the first hydraulic pump moves hydraulic fluid at the pump outlet, and the second hydraulic pump into the piston chamber, the torque of an electric motor driving the hydraulic pumps can—at a low required force—be used to move (pump) a great deal of hydraulic fluid into the piston chamber, whereby hydraulic fluid is moved (sucked) at the pump intake out of the annulus by the first hydraulic pump. The piston of the hydraulic cylinder can consequently be moved in a rapid stroke at a low force. After switching the directional control valve into the second switching position, only the first hydraulic pump still participates in the fluid exchange with the piston chamber of the hydraulic cylinder. It moves (pumps) hydraulic fluid at the pump outlet into the piston chamber, whereas at the pump intake it moves (sucks) hydraulic fluid out of the annulus.

If, in a so-called load stroke of the hydraulic cylinder, the piston impinges upon a counter force, for example, a work piece that is being processed in a hydraulic press, the required high pressure can be produced in that the torque of the electric motor driving the hydraulic pumps serves merely to produce the pressure in the first hydraulic pump. It is hereby conceivable that the second hydraulic pump is driven by the electric motor, but moves hydraulic fluid without pressure or almost without pressure from one tank into another tank.

The method also provides that the changeover from rapid stroke to load stroke can occur when a pressure limit in the piston chamber is exceeded. The changeover can occur by feeding back the pressure in the piston chamber to the directional control valve, so that the changeover occurs forcibly hydraulically controlled. If the piston of the hydraulic cylinder impinges upon a counter force, for example, a work piece that is to be processed in a hydraulic press, the pressure rising in the piston chamber can be used for shifting into the second switching position against the force of a return spring. When the pressure in the piston chamber drops again below the pressure limit, the return spring can move the directional control valve again into the starting position, in other words into the first switching position.

Another arrangement of the method provides that after completion of the load stroke, the directional control valve can be switched back from the second into the first switching position.

Switching back can occur when dropping below a pressure limit in the piston chamber or when exceeding a pressure limit in the annulus. When the pressure in the piston chamber drops, again below the pressure limit, the return spring of the directional control valve can again be moved into the starting position, in other words into the first switching position. If the high pressure is however present until the return point of the piston movement, the return spring cannot move the directional control valve back into the first switching position. Therefore, a feedback of the pressure in the annulus can be used, for example, by a hydraulic control line in such a way that when exceeding a pressure limit in the annulus the directional control valve can be switched back into the first switching position.

After completion of the load stroke, the direction of delivery of the pumps can be reversed. After reversing the directions of delivery, for example, after switching the directional control valve back from the first switching position into the first switching position, a rapid stroke of the piston can be provided. In the first switching position of the directional control valve hydraulic fluid can be moved (sucked) out of the piston chamber of the hydraulic cylinder with the first hydraulic pump at the pump outlet, and the second hydraulic pump, whereas with the first pump at the pump intake hydraulic fluid can be moved (pumped) into the annulus of the hydraulic cylinder.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
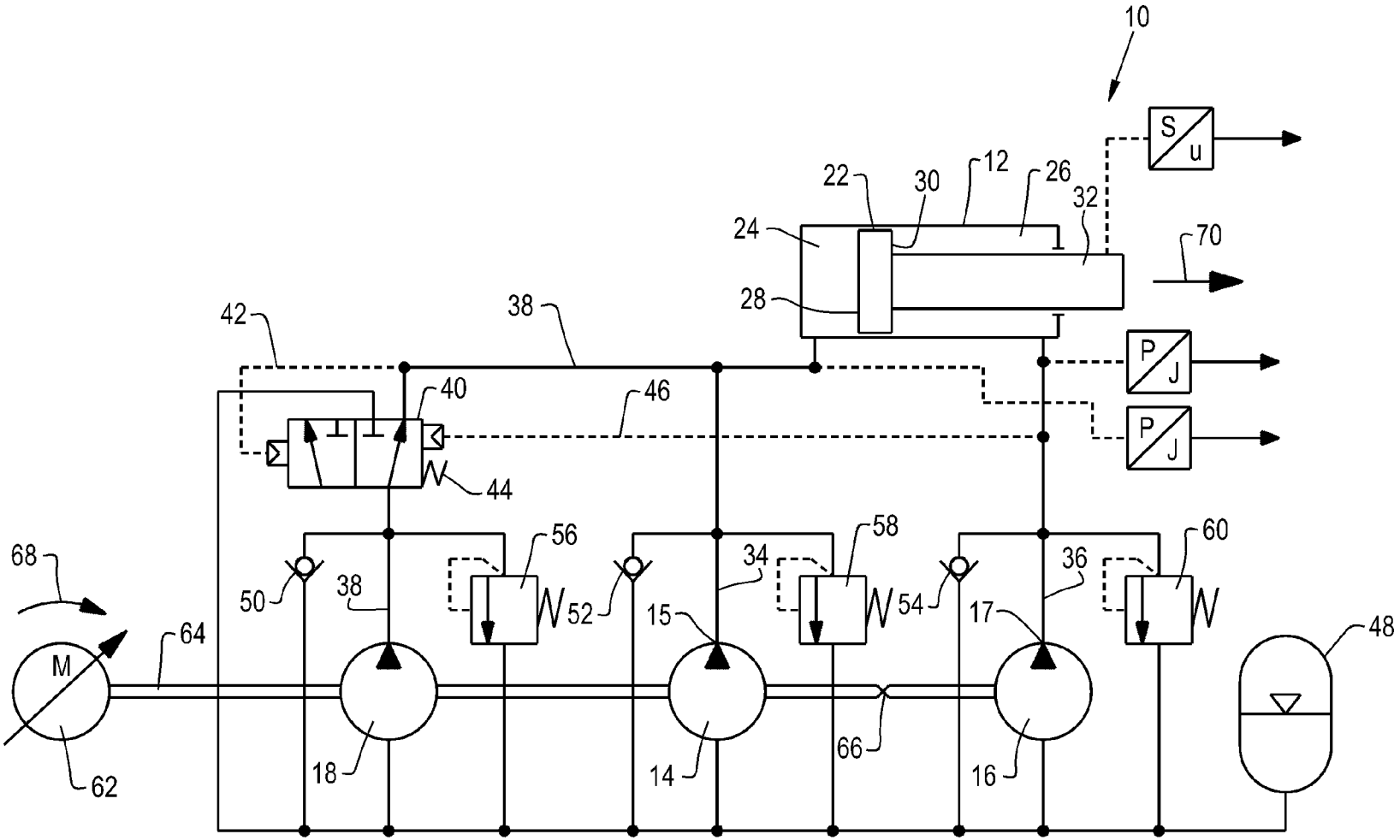
FIG. 1 is a diagram that illustrates a first embodiment of a hydraulic drive according to the present invention.

Referring now to FIG. 1, there is shown a hydraulic circuit diagram of a hydraulic drive 10 according to the present invention.

Drive 10 includes a hydraulic cylinder 12, which may be designed as a differential cylinder, as well as three hydraulic pumps 14, 16, 18 that are driven entirely by an electric motor 62.

Hydraulic cylinder 12 includes a piston 22 that separates a piston chamber 24 from an annulus 26. Piston chamber 24 has a hydraulic effective surface 28, whereby annulus 26 has a hydraulic effective surface 30. Because of piston rod 32 the hydraulic effective surface 30 of annulus 26 which is designed as a circular ring is smaller than hydraulic effective surface 28 of piston chamber 24.

Hydraulic pump 14 is hydraulically connected with piston chamber 24 of hydraulic cylinder 12 via a pump connection that is described as pump outlet 15 by a hydraulic line 34, whereas hydraulic pump 16 is hydraulically connected with annulus 26 of hydraulic cylinder 12 via a pump connection that is described as pump intake 17 by a second hydraulic line 36. The two hydraulic pumps 14, 16 deliver thereby in opposite directions and fulfil the function of a four-quadrant pump which has one pump intake and one pump outlet and with which—depending on the direction of delivery—hydraulic fluid can be sucked in at the pump intake and hydraulic fluid can be moved out of the pump at the pump outlet, and vice versa. For this reason the two hydraulic pumps 14, 16 are also referred to herein in part as first hydraulic pump 14, 16. Second hydraulic pump 18 can also be connected via directional control valve 40 with piston chamber 24 of the hydraulic cylinder by a third hydraulic line 38. Directional control valve 40 has a first switching position which is illustrated on the right in FIG. 1, as well as a second switching position which is illustrated on the left in FIG. 1. Directional control valve 40 is shown in its first switching position in FIG. 1.

Directional control valve 40 can be hydraulically controllable, whereby a first control line 42 is provided, whereby the pressure in piston chamber 24 is used to feed back to directional control valve 40 and for changeover from the first switching position into the second switching position. If the pressure in piston chamber 24 exceeds a pressure limit, a counter force can be overcome that is adjustable via a return spring 44, and directional control valve 40 is moved into the second switching position. When the pressure in piston chamber 24 drops again below the pressure limit, the directional control valve can again be moved by return spring 44 into the first switching position.

A second control line 46 may furthermore be provided, whereby the pressure from annulus 26 is used to feed back to directional control valve 40 and for changeover from the second switching position into the first switching position. This function is explained in further detail later in this text.

The three hydraulic pumps 14, 16, 18 are each connected with a hydraulic tank 48. Hydraulic pumps 14, 16, 18 can moreover be protected against vacuum or excess pressure via check valves 50, 52, 54 as well as pressure relief valves 56, 58, 69.

The three hydraulic pumps 14, 16, 18 can be driven by an electric motor 62 via a shaft 63. Hydraulic pump 14 and second hydraulic pump 18 have a direction of delivery corresponding with each other, whereas hydraulic pump 16 has a delivery direction in the opposite direction. The direction of rotation or respectively delivery direction in the opposite direction of hydraulic pump 16 is indicated by intersecting segment 66 of shaft 64.

The joint delivery volume of hydraulic pump 14 and second hydraulic pump 18 is adapted to hydraulic effective surface 28 of piston chamber 24, whereby the delivery volume of hydraulic pump 16 is adapted to hydraulic effective surface 30 of annulus 26. Consequently, the ratio of the joint delivery volume of hydraulic pump 14 and second hydraulic pump 18 relative to the delivery volume of hydraulic pump 16 is approximately consistent with the surface ratio of hydraulic effective surface 28 of piston chamber 24 relative to hydraulic effective surface 30 of annulus 26.

The inventive hydraulic drive 10 can function as follows:

If, during operation of hydraulic drive 10, for example when used in a hydraulic press that is not illustrated here, electric motor 62 rotates and directional control valve 40 is in its first switching position illustrated in FIG. 1, hydraulic pump 14 as well as also second hydraulic pump 18 are hydraulically connected with piston chamber 24 of hydraulic cylinder 12. If electric motor 62 rotates in the direction of arrow 68, pump 14 delivers hydraulic fluid at pump outlet 15, and second hydraulic pump 18 out of tank 48 into piston chamber 24. Hydraulic pump 16 again moves hydraulic fluid at pump intake 17 out of annulus 26 into tank 48. Due to delivery volume of hydraulic pumps 14, 16, 18 that is adapted to the surface ratio of hydraulic effective surfaces 28, 30 no, or almost no hydraulic fluid needs to be sucked back via check valves 50, 52, whereby also no or almost no hydraulic fluid is delivered via pressure relief valve 60 to tank 48.

When electric motor 62 rotates in the direction of arrow 68 and directional check valve 40 is in its first switching position, piston 22 or respectively piston rod 32 of hydraulic cylinder 12 moves in the direction of arrow 70 in a so-called rapid stroke at high speed.

If now, during operation of hydraulic drive 10, piston rod 32 or respectively a pressing tool that is arranged on piston rod 32 impinges on an obstacle, for example, a work piece that is to be processed, the pressure in piston chamber 24 increases. If the pressure in piston chamber 24 increases to above a preset pressure limit of directional control valve 40, a hydraulically forced guidance can be provided via control line 42. Directional control valve 40 is moved against the force of return spring 44 into the second switching position.

In the second switching position—at an unchanged rotational direction of electric motor 62—second hydraulic pump 18 moves hydraulic fluid without pressure or almost without pressure from tank 48 back into tank 48. It consequently does not participate in the fluid exchange with hydraulic cylinder 12.

Thus only hydraulic pump 14 still moves (pumps) hydraulic fluid into piston chamber 24, whereby hydraulic pump 16 moves (sucks) hydraulic fluid out of annulus 26. Electric motor 62 can now—at an unchanged motor torque—provide a higher pressure for a machining operation due to hydraulic pumps 14, 16 acting by themselves. Piston 22 or respectively piston rod 32 can thus be moved in a so-called load stroke at lower speed, however with greater force in the direction of arrow 70.

In the load stroke, the delivery volumes of hydraulic pumps 14, 16 are no longer adapted to the surface ratio of hydraulic effective surfaces 28, 30 since second hydraulic pump 18 moves hydraulic fluid only in the circuit. Additional hydraulic fluid is consequently subsequently sucked via check valve 54 since otherwise hydraulic pump 16 would create a vacuum in annulus 26.

After completion of the load stroke or respectively after completion of a machining operation, the pressure in piston chamber 24 drops off again. If the pressure in piston chamber 24 drops below the pressure limit of directional control valve 40 that is set by return spring 44, directional control valve 40 is again moved back into its first switching position that is illustrated in FIG. 1. If the direction of rotation of electric motor 62 is reversed, in other words if electric motor 62 or respectively shaft 64 rotate in opposite direction than that indicated by arrow 68, hydraulic pump 14 at pump outlet 15, and second hydraulic pump 18 move (suck) hydraulic fluid out of piston chamber 24 into tank 48, whereas hydraulic pump 16 at pump intake 17 moves (pumps) hydraulic fluid out of tank 48 into annulus 26 of hydraulic cylinder 12. On a reversal of the direction of rotation of electric motor 62, piston 22 or respectively piston rod 32 can thus again be moved back in a rapid stroke against the direction of arrow 70.

An exception can occur if the load in a machining operation is present until the return point of the movement of piston 22. A high pressure continues to prevail in piston chamber 24, so that directional control valve 40 cannot be moved into the first switching position by return spring 44 due to the pressure prevailing in first control line 42. If the direction of rotation of electric motor 62 is reversed in this condition against the direction of arrow 68, hydraulic pump 16 moves (pumps) hydraulic fluid out of tank 48 into annulus 26, whereby only hydraulic pump 14 pumps (sucks) hydraulic fluid out of piston chamber 24 into tank 48. Since also in this operational condition the delivery volumes of hydraulic pumps 14, 16 are not adapted to the surface volume of hydraulic effective surfaces 28, 20, the pressure in annulus 26 increases. If the pressure in annulus 26 which also prevails in second control line 46, together with the force of spring 44 exceeds the pressure prevailing in control line 42 or respectively in piston chamber 24, directional control valve 40 switches from the second switching position through hydraulically forced guidance back into the first switching position, whereby again second hydraulic pump 18 is hydraulically connected with piston chamber 24.

The delivery volumes of the three pumps 14, 16, 18 are now again adapted to the surface ratio of hydraulic effective surfaces 28, 30 and piston 22 or respectively piston rod 26 can be moved back in a rapid stroke against the direction of arrow 70.

Figure 2:
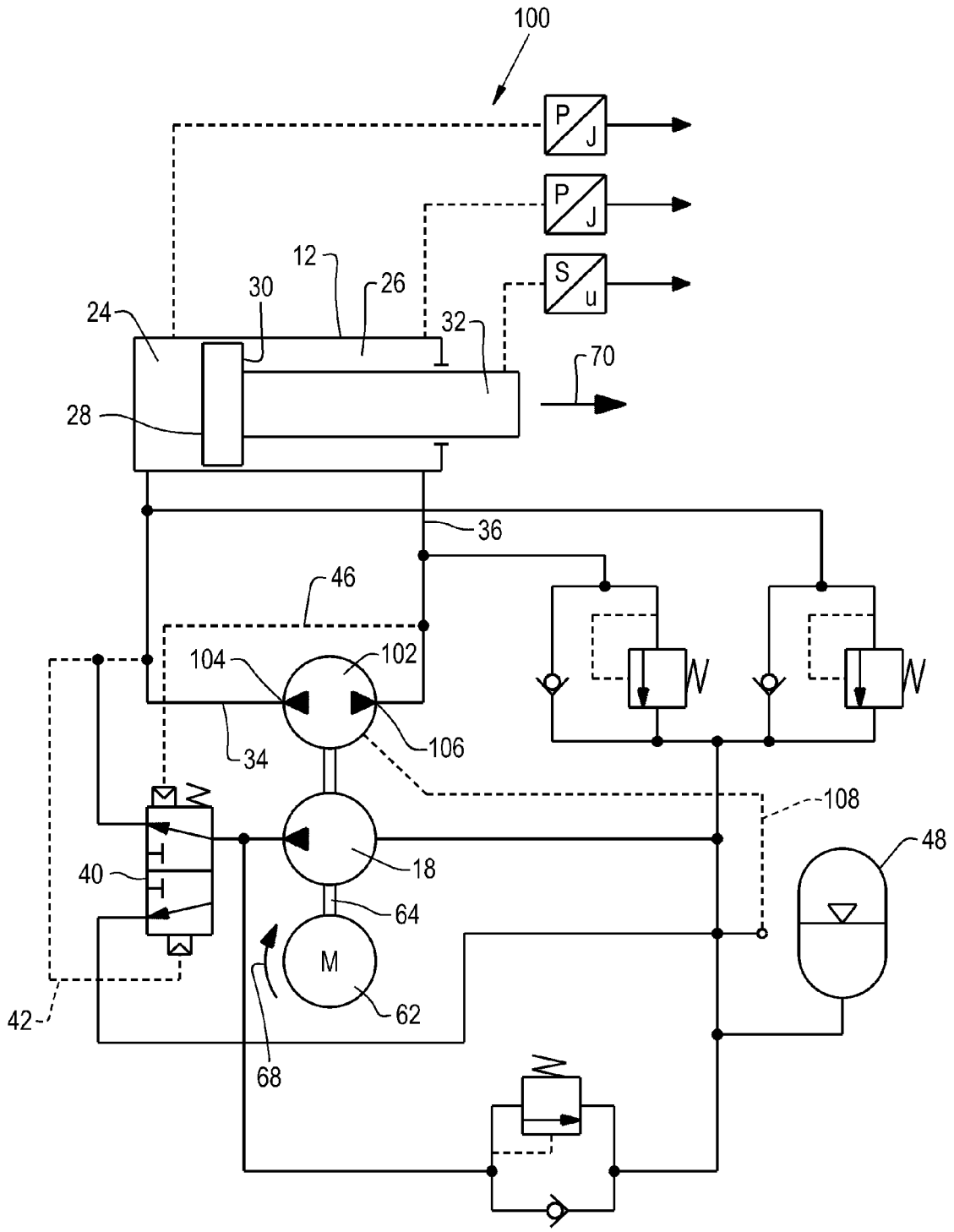
FIG. 2 is a diagram that illustrates a second embodiment of a hydraulic drive according to the present invention.

Referring now FIG. 2, there is shown a second embodiment of an inventive hydraulic drive 100. Corresponding elements are identified with corresponding reference numbers, whereby the functionality of hydraulic drive 100 is fundamentally consistent with the functionality of hydraulic drive 10 which is illustrated in FIG. 1.

Drive 100 includes a hydraulic cylinder 12 that may be designed as a differential cylinder, as well as a first hydraulic pump 102 that may be designed as a four-quadrant pump, and a second hydraulic pump 18, whereby hydraulic pumps 18, 102 can be driven entirely by an electric motor 62.

Hydraulic cylinder 12 comprises a piston 22 that separates a piston chamber 24 from an annulus 26. Piston chamber 24 has a hydraulic effective surface 28, whereby annulus 26 has a hydraulic effective surface 30. Because of piston rod 32, hydraulic effective surface 30 of annulus 26 which is round is smaller than hydraulic effective surface 28 of piston chamber 24.

Hydraulic pump 102 is hydraulically connected with piston chamber 24 of hydraulic cylinder 12 with a pump connection that is identified as pump outlet 104 by a hydraulic line 34, whereas hydraulic pump 102 is hydraulically connected with annulus 26 of hydraulic cylinder 12 with a pump connection that is identified as pump intake 106 by a hydraulic line 36. Hydraulic pump 102 which can be designed as four-quadrant pump delivers hereby in opposite directions at pump intake 106 and at pump outlet 104, whereby depending on the direction of delivery at pump intake 106 hydraulic fluid can be sucked in and hydraulic fluid can be moved out of pump 102 at pump outlet 104, and vice versa.

Second hydraulic pump 18 can also be connected via directional control valve 40 with piston chamber 24 of the hydraulic cylinder by a third hydraulic line 38. Directional control valve 40 has a first switching position that is illustrated on top of FIG. 2, as well as a second switching position that is shown on the bottom of FIG. 2. Directional control valve 40 is shown in its first switching position in FIG. 2.

Directional control valve 40 is hydraulically controllable, whereby a first control line 42 is provided, whereby the pressure in piston chamber 24 is used to feed back to directional control valve 40 and for changeover from the first switching position into the second switching position. If the pressure in piston chamber 24 exceeds a pressure limit, a counter force can be overcome that is adjustable via a return spring 44, and directional control valve 40 can be moved into the second switching position. When the pressure in piston chamber 24 drops again below the pressure limit, the directional control valve can again be moved by return spring 44 into the first switching position.

A second control line 46 is furthermore provided, whereby the pressure from annulus 26 is used to feed back to directional control valve 40 and for changeover from the second switching position into the first switching position. This function is explained in further detail later in this text.

Hydraulic pump 18 is hydraulically connected with a tank 48. Hydraulic pumps 18, 102 are driven by an electric motor 62 via a shaft 64.

The joint delivery volume of hydraulic pump 102 at pump outlet 104 and of second hydraulic pump 18 is adapted to hydraulic effective surface 28 of piston chamber 24, where the delivery volume of hydraulic pump 102 at pump intake 106 is adapted to hydraulic effective surface 30 of annulus 26. Consequently, the ratio of the joint delivery volume of hydraulic pump 102 at pump outlet 104 and of second hydraulic pump 18 relative to the delivery volume of hydraulic pump 102 at pump intake 106 is approximately consistent with the surface ratio of hydraulic effective surface 28 of piston chamber 24 relative to hydraulic effective surface 30 of annulus 26.

The inventive hydraulic drive 100 can function as follows:

If, during operation of hydraulic drive 100, for example, when used in a hydraulic press that is not illustrated here, electric motor 62 rotates and directional control valve 40 is in its first switching position illustrated in FIG. 2, pump outlet 104 of hydraulic pump 104 as well as also second hydraulic pump 18 are hydraulically connected with piston chamber 24 of hydraulic cylinder 12. If electric motor 62 rotates in the direction of arrow 68, hydraulic pump 102 at pump outlet 104, and second hydraulic pump 18 deliver hydraulic fluid, into piston chamber 24. Hydraulic pump 102 again moves hydraulic fluid out of annulus 26 at pump intake 106.

When electric motor 62 rotates in the direction of arrow 68 and directional check valve 40 is in its first switching position, piston 22 or respectively piston rod 32 of hydraulic cylinder 12 moves in the direction of arrow 70 in a so-called rapid stroke at high speed.

If now, during operation of hydraulic drive 100, piston rod 32 or respectively a pressing tool that is arranged on piston rod 32 impinges on an obstacle, for example, a work piece that is to be processed, the pressure in piston chamber 24 increases. If the pressure in piston chamber 24 increases to above a preset pressure limit of directional control valve 40, a hydraulically forced guidance can be provided via control line 42. Directional control valve 40 is moved against the force of return spring 44 into the second switching position.

In the second switching position—at unchanged rotational direction of electric motor 62—second hydraulic pump 18 moves hydraulic fluid without pressure or almost without pressure from tank 48 back into tank 48. It consequently does not participate in the fluid exchange with hydraulic cylinder 12.

Thus only hydraulic pump 102 still moves (pumps) hydraulic fluid at pump outlet 104 into piston chamber 24, whereby hydraulic pump 102 moves (sucks) hydraulic fluid at pump intake 106 out of annulus 26. Electric motor 62 can now—at unchanged motor torque—provide a higher pressure for a machining operation due to hydraulic pump 102 acting alone. Piston 22 or respectively piston rod 32 can thus be moved in a so-called load stroke at lower speed, however with greater force in the direction of arrow 70.

In the load stroke the delivery volumes of hydraulic pump 102 is no longer adapted to the surface ratio of hydraulic effective surfaces 28, 30 since second hydraulic pump 18 moves hydraulic fluid only in the circuit. Additional hydraulic fluid must consequently subsequently be sucked via a feed line 108 since otherwise hydraulic pump 102 would create a vacuum in annulus 26.

After completion of the load stroke or respectively after completion of a machining operation the pressure in piston chamber 24 drops off again. If the pressure in piston chamber 24 drops below the pressure limit of directional control valve 40 that is set by return spring 44, directional control valve 40 is again moved back into its first switching position that is illustrated in FIG. 2. If the direction of rotation of electric motor 62 is reversed, in other words if electric motor 62 or respectively shaft 64 rotate in opposite direction than that indicated by arrow 68, hydraulic pump 102 at pump outlet 104, and second hydraulic pump 18 move (suck) hydraulic fluid out of piston chamber 24 into tank 48, whereas hydraulic pump 102 at pump intake 106 moves (pumps) hydraulic fluid out of tank 48 into annulus 26 of hydraulic cylinder 12. On a reversal of the direction of rotation of electric motor 62, piston 22 or respectively piston rod 32 can thus again be moved back in a rapid stroke against the direction of arrow 70.

An exception can occur if the load in a machining operation is present until the return point of the movement of piston 22. The a high pressure then continues to prevail in piston chamber 24, so that directional control valve 40 cannot be moved into the first switching position by return spring 44 due to the pressure prevailing in first control line 42. If the direction of rotation of electric motor 62 is reversed in this condition against the direction of arrow 68, hydraulic pump 102 moves (pumps) hydraulic fluid out of tank 48 into annulus 26, whereby only hydraulic pump 102 pumps (sucks) hydraulic fluid out of piston chamber 24 into tank 48. Since also in this operational condition the delivery volumes of hydraulic pump 102 are not adapted to the surface volume of hydraulic effective surfaces 28, 20, the pressure in annulus 26 increases. If the pressure in annulus 26 which also prevails in second control line 46, together with the force of spring 44 exceeds the pressure prevailing in control line 42 or respectively in piston chamber 24, directional control valve 40 switches from the second switching position through hydraulically forced guidance back into the first switching position, whereby again second hydraulic pump 18 is hydraulically connected with piston chamber 24.

The delivery volumes of pumps 18, 102 are now again adapted to the surface ratio of hydraulic effective surfaces 28, 30 and piston 22 or respectively piston rod 32 can be moved back in a rapid stroke against the direction of arrow 70.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic drive for a hydraulic press, said hydraulic drive comprising:

at least one hydraulic cylinder, including:

a piston chamber and an annulus; and a piston that separates said piston chamber from said annulus; a first hydraulic pump having a direction of fluid delivery, said first hydraulic pump is in the form of a four-quadrant pump, said first hydraulic pump including:

a pump intake hydraulically connected with said annulus; and a pump outlet hydraulically connected with said piston chamber; a second hydraulic pump having a direction of fluid delivery that is consistent with said direction of fluid delivery of the first hydraulic pump at said pump outlet, said second hydraulic pump is selectively and hydraulically connected with said piston chamber and said second hydraulic pump does not supply pressurized fluid to said annulus of said at least one hydraulic cylinder; and a directional control valve that has a first switching position and a second switching position, wherein said second hydraulic pump in said first switching position of the directional control valve is hydraulically connected with said piston chamber and wherein said second hydraulic pump in said second switching position of the directional control valve is not hydraulically connected with said piston chamber, wherein said directional control valve is hydraulically controllable in such a way that a pressure in said piston chamber is used for shifting said directional control valve from the first switching position into the second switching position, and a pressure in said annulus is used for shifting the directional control valve from the second switching position into the first switching position.

2. The hydraulic drive according to claim 1, wherein said piston chamber has a hydraulic effective surface and said annulus has a hydraulic effective surface, further wherein a joint delivery volume of said first hydraulic pump at said pump outlet and of said second hydraulic pump relative to a delivery volume of said first hydraulic pump at said pump intake are at a ratio that is consistent with a surface ratio of the hydraulic effective surface of the piston chamber relative to the hydraulic effective surface of the annulus.

3. The hydraulic drive according to claim 1, further including a tank that is hydraulically connected with said first hydraulic pump.

4. The hydraulic drive according to claim 3, wherein said tank that is in the form of a pressure tank.

5. The hydraulic drive according to claim 3, further including a plurality of check valves and a plurality of pressure relief valves which are arranged between said pump outlet of the first hydraulic pump and said second hydraulic pump and piston chamber in such a way that a hydraulic fluid can be diverted into said tank in order to avoid at least one excess pressure and that the hydraulic fluid can be moved out of said tank in order to avoid at least one vacuum.

6. The hydraulic drive according to claim 4, further including a plurality of check valves and a plurality of pressure relief valves which are arranged respectively between said pump intake of the first hydraulic pump and said annulus in such a way that a hydraulic fluid can be diverted into said tank in order to avoid at least one excess pressure and that the hydraulic fluid can be moved out of said tank in order to avoid at least one vacuum.

7. The hydraulic drive according to claim 1, wherein said first hydraulic pump and said second hydraulic pump are each in the form of a fixed displacement pump.

8. The hydraulic drive according to claim 1, wherein said first hydraulic pump and said second hydraulic pump are each in the form of a gear pump.

9. The hydraulic drive according to claim 1, further including at least one of a position sensor and at least one pressure sensor.

10. A method to operate a hydraulic drive having a hydraulic fluid therein and including at least one hydraulic cylinder that includes a piston chamber, an annulus and a piston that separates said piston chamber from said annulus, a first hydraulic pump having a pump intake and a pump outlet, at least one a second hydraulic pump, said second hydraulic pump is selectively and hydraulically connected with said piston chamber and said second hydraulic pump does not supply pressurized fluid to said annulus of said at least one hydraulic cylinder and a directional control valve that has a first and a second switching position, the method comprising the steps of:

moving hydraulic fluid, in a first stroke, via said first hydraulic pump at said pump outlet and via said second hydraulic pump into said piston chamber;

moving hydraulic fluid out of said annulus via said first hydraulic pump at said pump intake; and moving hydraulic fluid, in a second stroke, at said pump outlet into said piston chamber and moving hydraulic fluid from said annulus to said pump intake via said first hydraulic pump, wherein a changeover from the first stroke to the second stroke occurs through switching of said directional control valve from the first switching position to the second switching position.

11. The method according to claim 10, wherein the changeover from the first stroke to the second stroke occurs when a pressure limit in said piston chamber is exceeded.

12. The method according to claim 10, wherein after completion of the second stroke, said directional control valve is switched back from the second switching position into the first switching position.

13. The method according to claim 12, wherein the switching back of said directional control valve occurs when dropping below a pressure limit in said piston chamber.

14. The method according to claim 12, wherein the switching back of said directional control valve occurs when exceeding a pressure limit in said annulus.

15. The method according to claim 10, wherein after completion of the second stroke a direction of delivery of said first hydraulic pump is reversed.

* * * * *